US008162428B2

(12) United States Patent
Eun et al.

(10) Patent No.: US 8,162,428 B2
(45) **Date of Patent: *Apr. 24, 2012**

(54) SYSTEM AND METHOD FOR COMPENSATING RUNOUT ERRORS IN A MOVING WEB PRINTING SYSTEM

(75) Inventors: Yongsoon Eun, Webster, NY (US); Jeffrey J. Folkins, Rochester, NY (US); Jess R. Gentner, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 355 days.

This patent is subject to a terminal disclaimer.

(21) Appl. No.: 12/561,987

(22) Filed: Sep. 17, 2009

(65) Prior Publication Data

US 2011/0063355 A1 Mar. 17, 2011

(51) Int. Cl.
*B41J 29/38* (2006.01)

(52) U.S. Cl. ..... 347/16

(58) Field of Classification Search ..... 347/14, 347/16, 19, 37, 101, 104
See application file for complete search history.

(56) References Cited

U.S. PATENT DOCUMENTS

| | | | | |
|---|---|---|---|---|
| 4,903,067 | A | 2/1990 | Murayama et al. | |
| 4,990,767 | A | 2/1991 | Ernst et al. | |
| 5,193,918 | A | 3/1993 | Lohrmann et al. | |
| 5,287,160 | A | 2/1994 | Dastin et al. | |
| 5,412,302 | A | 5/1995 | Kido et al. | |
| 5,455,668 | A | 10/1995 | De Bock et al. | |
| 5,499,093 | A | 3/1996 | Aerens et al. | |
| 5,600,352 | A | 2/1997 | Knierim et al. | |
| 5,828,937 | A | 10/1998 | Aerens et al. | |
| 6,076,922 | A | 6/2000 | Knierim et al. | |
| 6,133,932 | A | 10/2000 | Webb et al. | |
| 6,215,119 | B1 | 4/2001 | Markham et al. | |
| 6,307,578 | B1 | 10/2001 | Castelli | |
| 6,330,424 | B1 | 12/2001 | Chapman et al. | |
| 6,374,076 | B1 * | 4/2002 | Tanaka | 399/396 |
| 6,407,678 | B1 | 6/2002 | Elgee et al. | |
| 6,823,786 | B1 | 11/2004 | Shmaiser et al. | |
| 7,085,508 | B2 | 8/2006 | Igarashi | |
| 7,126,621 | B2 | 10/2006 | Castelli et al. | |
| 7,245,862 | B2 | 7/2007 | Ebara | |
| 7,467,838 | B2 | 12/2008 | Folkins et al. | |
| 7,583,920 | B2 | 9/2009 | Willemsens et al. | |
| 7,587,157 | B2 * | 9/2009 | Matsuda et al. | 399/301 |
| 2003/0210932 | A1 | 11/2003 | Koide et al. | |
| 2006/0024104 | A1 | 2/2006 | Castelli et al. | |
| 2008/0088661 | A1 | 4/2008 | Folkins et al. | |
| 2008/0170111 | A1 | 7/2008 | Suzuki et al. | |
| 2008/0252710 | A1 | 10/2008 | Yasutani et al. | |
| 2010/0133738 | A1 | 6/2010 | Kawachi et al. | |

OTHER PUBLICATIONS

US 7,673,987, 03/2010, Von Essen et al. (withdrawn)

* cited by examiner

*Primary Examiner* — An Do
(74) *Attorney, Agent, or Firm* — Maginot, Moore & Beck, LLP

(57) ABSTRACT

A method compensates for runout errors in a web printing system. The method includes identifying runout error at a first roller driving a web of printable media, generating a runout compensation value corresponding to the identified runout error, identifying a velocity of the moving web with reference to encoder output corresponding to an angular velocity of the first roller and the generated runout compensation value, and delivering a firing signal to a print head proximate the first roller to energize the inkjet nozzles in the print head and eject ink onto the web at a position corresponding to the computed web velocity.

19 Claims, 3 Drawing Sheets

SYSTEM AND METHOD FOR COMPENSATING RUNOUT ERRORS IN A MOVING WEB PRINTING SYSTEM

TECHNICAL FIELD

This disclosure relates generally to web printing systems, and more particularly, to web printing systems that use a series of print heads in a print zone to form images on the web.

BACKGROUND

A known system for ejecting ink to form images on a moving web of media material is shown in FIG. 4. The system 10 includes a web unwinding unit 14, a media preparation station 18, a pre-heater roller 22, a plurality of marking stations 26, a turn roller 30, a leveling roller 34, and a spreader 38. In brief, the web unwinding unit 14 includes an actuator, such as an electrical motor, that rotates a web of media material in a direction that removes media material from the web. The media material is fed through the media preparation station 18 along a path formed by the pre-heater roller 22, turn roller 30, and leveling roller 34 and then through the spreader 38 to a rewinder 40. The media preparation station 18 removes debris and loose particulate matter from the web surface to be printed and the pre-heater roller 22 is heated to a temperature that transfers sufficient heat to the media material for optimal ink reception on the web surface as it passes the marking stations 26. Each of the marking stations 26A, 26B, 26C, and 26D in FIG. 4 includes two staggered full width print head arrays, each of which has three or more print heads that eject ink onto the web surface. The different marking stations eject different colored inks onto the web to form a composite colored image. In one system, the marking stations eject cyan, magenta, yellow, and black ink for forming composite colored images. The surface of the web receiving ink does not encounter a roller until it contacts the leveling roller 34. Leveling roller 34 modifies the temperature of the web and reduces any temperature differences between inked and non-inked portions of the web. After the temperature leveling the ink is heated by heater 44 before the printed web enters the spreader 38. The spreader 38 applies pressure to the ejected ink on the surface of the web to smooth the roughly semicircular ink drops on the surface of the web and to encourage ink fill with the different colors and present a more uniform image to a viewer. The web material is then wound around the rewinding unit 40 for movement to another system for further processing of the printed web.

This system 10 also includes two load cells, one of which is mounted at a position near pre-heater roller 22 and the other is mounted at a position near the turn roller 30. These load cells generated signals corresponding to the tension on the web proximate the position of the load cell. Each of the rollers 22, 30, and 34 has an encoder mounted near the surface of the roller. These encoders may be mechanical or electronic devices that measure the angular velocity of a roller monitored by the encoder, which generates a signal corresponding to the angular velocity of the roller. In a known manner, the signal corresponding to the angular velocity measured by an encoder is provided to the controller 60, which converts the angular velocity to a linear web velocity. The linear web velocity may also be adjusted by the controller 60 with reference to the tension measurement signals generated by the load cells. The controller 60 is configured with I/O circuitry, memory, programmed instructions, and other electronic components to implement a double reflex printing system that generates the firing signals for the printheads in the marking stations 26. A double reflex printing process is described in U.S. patent application Ser. No. 11/605,735 entitled "Double Reflex Printing" and published as U.S. Publication Number 2008/0125158 and commonly owned by the assignee of the present document. The term "controller" or "processor" as used in this document refers to a combination of electronic circuitry and software that generates electrical signals that control a portion or all of a process or system.

The system 10 may also include an image-on-web array (IOWA) sensor 68 that generates an image signal of a portion of the web as it passes the IOWA sensor. The IOWA sensor 68 may be implemented with a plurality of optical detectors that are arranged in a single or multiple row array that extends across at least a portion of the web to be printed. The detectors generate signals having an intensity corresponding to a light reflected off the web. The light is generated by a light source that is incorporated in the IOWA sensor and directed toward the web surface to illuminate the surface as it passes the optical detectors of the IOWA sensor. The intensity of the reflected light is dependent upon the amount of light absorbed by the ink on the surface, the light scattered by the web structure, and the light reflected by the ink and web surface. The image signal generated by the IOWA sensor is processed by an integrated registration color controller (IRCC) to detect the presence and position of ink drops ejected onto the surface of the web at the IOWA sensor.

As noted above, the controller 60 uses the tension measurements from the two load cells along with the angular velocity measurements from encoders to compute linear web velocities at the rollers 22, 30, and 34. These linear velocities enable the controller to determine when a web portion printed by one marking station, station 26A, for example, is opposite another marking station, stations 26B, for example, so the second marking station can be operated by the controller 60 with firing signals to eject ink of a different color onto the web in proper registration with the ink already placed on the web by a previous marking station. When the subsequent marking station is operated too soon or too late, the ejected ink lands on the web at positions that may produce visual noise in the image. This effect is known as misregistration. Accurate measurements, therefore, are important in registration of different colored images on the web to produce images with little or no visual noise.

The accuracy of web velocity measurement by a rotary encoder is dependent upon the quality of the roller and its mounting, and the quality of the encoder and its mounting. Imperfections in the cylinder forming the roller cause the radius of the roller to change, which affects the accuracy of the web velocity measurement. Similarly, eccentricity, wobble, or other cyclic imperfections of the roller may affect the accuracy as well. Likewise, the encoder may possess imperfections or be mounted in a way that introduces error in the generated web velocity signal. Under double or single reflex printing method, such errors in the web velocity measurement affect the timing of the firing signals for the print heads that eject ink as the web passes by the print heads, and results in mis-registration of the images. Since the web velocity error arise from the rotating roll and encoder, it shows on a print as a periodic mis-registration, periodicity of which corresponds the once around of the roller. This is denoted as runout errors in this document.

SUMMARY

A method has been developed that compensates for runout errors in a web printing system. The method includes identifying runout error at a first roller driving a web of printable media, generating a runout compensation value corresponding to the identified runout error, identifying a velocity of the moving web with reference to encoder output corresponding to an angular velocity of the first roller and the generated runout compensation value, and delivering a firing signal to a print head proximate the first roller to energize the inkjet nozzles in the print head and eject ink onto the web at a position corresponding to the identified web velocity.

A system enables a controller operating a web printing system to compensate for runout error in rollers or encoders positioned within a print zone of a web printing system. The system includes a first roller configured to rotate in response to a web moving through a print zone of a web printing system, a first encoder mounted proximate the first roller to generate a signal corresponding to an angular velocity of the first roller, a print head positioned in the print zone proximate the web, and a controller coupled to the first encoder and the print head, the controller being configured to compute a web velocity for the web moving through the print zone with reference to the signal received from the first encoder and runout compensation values stored in a memory coupled to the controller and the controller sending a firing signal to the print head to operate the print head and eject ink onto the web at a position corresponding to the computed web velocity.

BRIEF DESCRIPTION OF THE DRAWINGS

The foregoing aspects and other features of a system and a method that compensate for runout errors at rollers driving a web of printable media are explained in the following description, taken in connection with the accompanying drawings.

DETAILED DESCRIPTION

Figure 1:
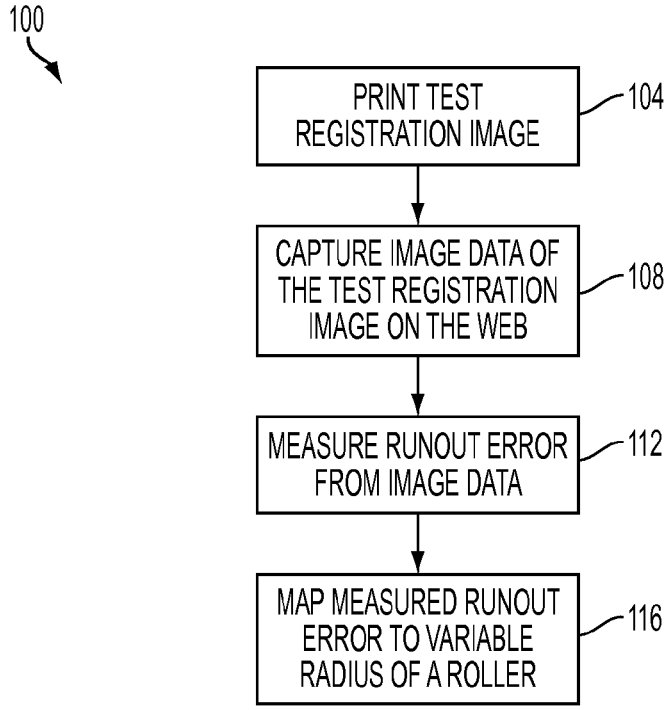
FIG. 1 is a flow diagram of a process that may be implemented to identify runout error in a web printing system and to compensate for that error with a variable radius for a roller that is used to identify a velocity at a particular position for the web.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, or the like. Also, the description presented below is directed to a system for operating a printer that forms images on a moving web driven by rollers. The reader should also appreciate that the principles set forth in this description may be applicable to imaging systems that form images on sheets.

In one embodiment of a web printing system, the marking stations are solid ink marking stations. Solid ink marking stations use ink that is delivered in solid form to the printer, transported to a melting device where the ink is heated to a melting temperature and converted to liquid ink. The liquid ink is supplied to the print heads in the marking stations and ejected from the print heads onto the moving web in response to firing signals generated by the controller 60. In such a continuous feed direct marking system, the print zone is the portion of the web extending from the first marking station to the last marking station. In some systems, this print zone may be several meters long.

As noted in the discussion of the background above, errors in the web velocity may be introduced by irregularities in the radius of a roller, wobble in the rotation of a roller, or imperfections in the encoder. To address these sources of web velocity and position error, a method and system have been developed that measures the runout error in the measurement of a web velocity and generates compensation values for the runout error. In one embodiment, these compensation values are used to model the radius of a roller as a variable parameter that is implemented with a lookup table. Such an embodiment may be used in a printing system that uses a single reflex registration system or that positions an image on an intermediate imaging member for transfer to media. In another embodiment, compensation values are stored and used for each roller in a printing zone to enable a double reflex registration system to interpolate web velocity and position between rollers in the printing zone more accurately.

Measurement of the runout error in one embodiment may be obtained with the method shown in FIG. 1. The method 100 prints a registration test image on a moving web (block 104). The registration test image may be a series of ejected ink drops by each ink jet in a print head to generate a series of vertical lines. Image data corresponding to the test image printed on the web is captured (block 108). The registration test image may be captured by an optical sensor that generates an image signal of a portion of the web on which the test image was printed as it passes the optical sensor. In one embodiment, the optical sensor is implemented with an image-on-web array (IOWA) sensor 68. Alternatively, the test image may be scanned by an offline scanner and the resulting image data may be transmitted to the printer or other image processing system for further analysis. The test image data are analyzed to measure errors associated with the placement of ink on the web (block 112). In one embodiment, IOWA 68 is coupled to the controller 60 and the controller 60 executes a program stored in memory to analyze the image data corresponding to the test registration pattern on the moving web that was generated by the IOWA. The analysis enables the controller 60 to measure the registration errors between corresponding scanlines in the test registration pattern printed onto the moving web. Periodic variations in the position of a scanline corresponding to an inkjet may be attributable to runout error, which exhibits a periodic characteristic as it occurs during each revolution of a roller. Alternatively, the runout error of a roller or an encoder may be measured mechanically using known techniques rather than using a test registration image.

Once the runout errors are measured, the compensation values corresponding to the errors are mapped to a change in radius for a particular sector of a roller circumference (block 116). In one embodiment, the circumference of a roller is divided into sixty-four (64) sectors and a change in radius is assigned to each sector as a compensation value. Such a mapping may be implemented in a look-up table using an angular sector identifier as an index and the change in radius as the content of an indexed cell. Thereafter, the controller implementing the image registration process incorporates the variable radius in the web velocity computations that are used to time the delivery of firing signals to the print heads.

In previously known image registration systems, the radius R of a roller used in an image registration control system is treated as a constant. This approach, however, does not compensate for the runout errors arising from roller or encoder irregularities. To provide a scheme that compensates for the runout errors, the radius R of a roller may be described with a function having the form:

$$R=r+f(\theta)$$

In this relationship, R is the sum of a constant length r plus a changing length that compensates for a runout error for a particular sector of a roller circumference. That is, θ is the angular position of a roller (or encoder) and $f(\theta)$ is the variable through which the effect of runout is compensated. Once $f(\theta)$ is computed with reference to the image data obtained from the test registration image, a lookup table in which the radius variations are indexed by the variable θ may be generated. In one embodiment, the [0, 2π] range for rotation of a roller is divided into 64 segments and a lookup table having the radius variation $f(\theta)$ for one of the 64 values of θ is produced. This radius variation is added to the baseline value r to establish R for the current angular position of the roller.

The process for establishing the values of $f(\theta)$ for various θ is now described with reference to FIG. 2. In the system 200, a web 204 moves over roller 208 and roller 212 as the web is printed with ink ejected from the print heads 216 and 220. In printing systems in which multiple rollers are used, the rollers in the printing zone are configured with different diameters that are not integral multiples of one another. Such a configuration enables the analysis of the runout error for each roller to be deconvolved from the runout errors associated with the other rollers as each error occurs at a different frequency. In order to analyze the entire runout error arising from a roller, the length of the test registration image needs to be greater than the circumference of the roller whose error is being measured. Such a length enables the roller to complete at least one revolution as the registration test image is printed by the print head immediately upstream or downstream of the roller.

Figure 2:
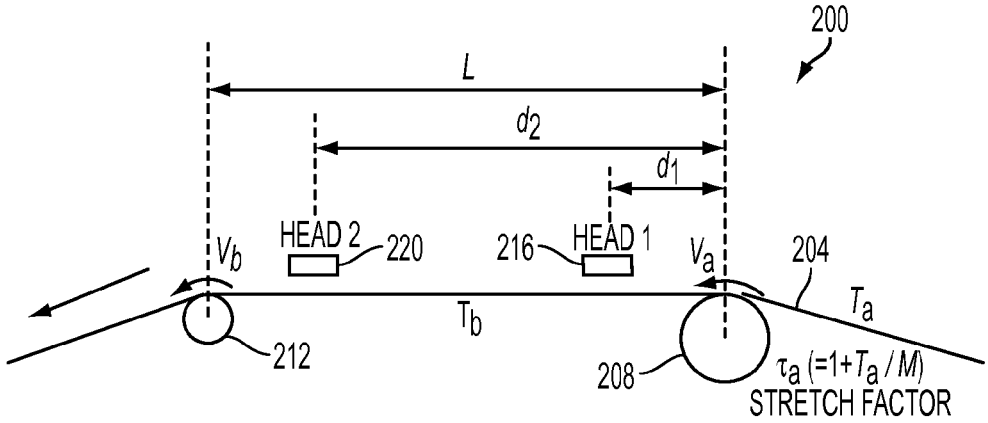
FIG. 2 is a block diagram of a system in which runout error is identified for one of the rollers in the system.

With further reference to FIG. 2, L is the length between the centers of the two rollers 208 and 212 that have encoders that generate signals corresponding to the speed of the web passing over the roller monitored by the encoder. Similarly, $d_1$ and $d_2$ are the distances between the center of the roller 208 and the print head 216 and the print head 220, respectively. Web linear velocity at the roller 208 is denoted by $V_a$ and web velocity at the roller 212 is denoted by $V_b$. The stretch factor $\tau_a$ is related to the tension of the web $T_a$ and the modulus of elasticity M for the web 204. Registration error e(k) may be defined by the position difference between the kth scanline in the test registration image printed by print head 216 and the kth scanline printed by print head 220. Negative values mean that print head 220 is printing too late to be properly imposed on the kth scanline printed by print head 216. In the image registration control process, the radii of the two rollers on either side of a print head are given as:

$$R_a(\theta_a)=r_a+f_a, R_b(\eta_b)=r_b+f_b(\theta_b).$$

The problem is to find the functions $f_a(\theta)$ and $f_b(\theta)$ from the registration errors detected from the image of the test registration pattern generated by the IOWA or offline scanner. Both functions are periodic with the period of 2π, and have a zero mean by definition. Using this fact, the function $f_a(\theta)$ can be written as:

$$f_a(\theta_a)=\sum_{n=1}(\alpha_n\cos n\theta_a+\beta_n\sin n\theta_b)$$

and similarly for $f_b(\theta_b)$. Then $\alpha_n$, $\beta_n$ can be found from the registration error e(k).

First, solving for $f_a(\theta_a)$ is discussed. Since the position $\theta_a$ is detected while the test pattern is being printed, the error can be expressed as a function of $\theta_a$. Various techniques can be used to extract the nth harmonic from $e(\theta_a)$. The nth harmonics of the function $f_a(\theta_a)$ may be denoted by:

$$M_n\sin(n\theta_a+\psi_n).$$

Then, $\alpha_n$, $\beta_n$ for $f_a(\theta)$ are determined by solving:

$$\begin{bmatrix} M_n\cos\psi_n \\ M_n\sin\psi_n \end{bmatrix}=\frac{1}{\tau}\begin{bmatrix} -\frac{L-d_1}{nL}+\frac{L-d_2}{nL}\cos n\varphi & \frac{L-d_2}{nL}\sin n\varphi \\ \frac{L-d_2}{nL}\sin n\varphi & \frac{L-d_1}{nL}-\frac{L-d_2}{nL}\cos n\varphi \end{bmatrix}\begin{bmatrix} \alpha_n \\ \beta_n \end{bmatrix}$$

In the equation above, $\tau_a\approx\tau_b\approx\tau$ is assumed, and $\phi=\theta_a(2)-\theta_a(1)$, where $\theta_a(1)$ is the position of encoder a when print head 216 is printing the first scanline, and $\theta_a(2)$ is the position of the encoder a when print head 220 is printing the first scanline. A similar procedure applies to the finding of $f_b(\theta_b)$. In this case, the position $\theta_b$ is used and the error is expressed as a function of $\theta_b$. Then the nth harmonic is extracted and denoted by $M_n\sin(n\theta_b+\psi_n)$. Solving:

$$\begin{bmatrix} M_n\cos\psi_n \\ M_n\sin\psi_n \end{bmatrix}=\frac{1}{\tau}\begin{bmatrix} -\frac{d_1}{nL}+\frac{d_2}{nL}\cos n\varphi & \frac{d_2}{nL}\sin n\varphi \\ \frac{d_2}{nL}\sin n\varphi & \frac{d_1}{nL}-\frac{d_2}{nL}\cos n\varphi \end{bmatrix}\begin{bmatrix} \alpha_n \\ \beta_n \end{bmatrix}$$

where $\phi=\theta_b(2)-\theta_b(1)$, where $\theta_b(1)$ is the position of encoder b when print head 216 is printing the first scanline, and $\theta_b(2)$ is the position of the encoder b when print head 220 is printing the first scanline, enables one to obtain $f_b(\theta_b)$. Typically, compensating the first harmonic component (n=1) is adequate, however, the method may be used to compensate higher order harmonics.

Figure 3:
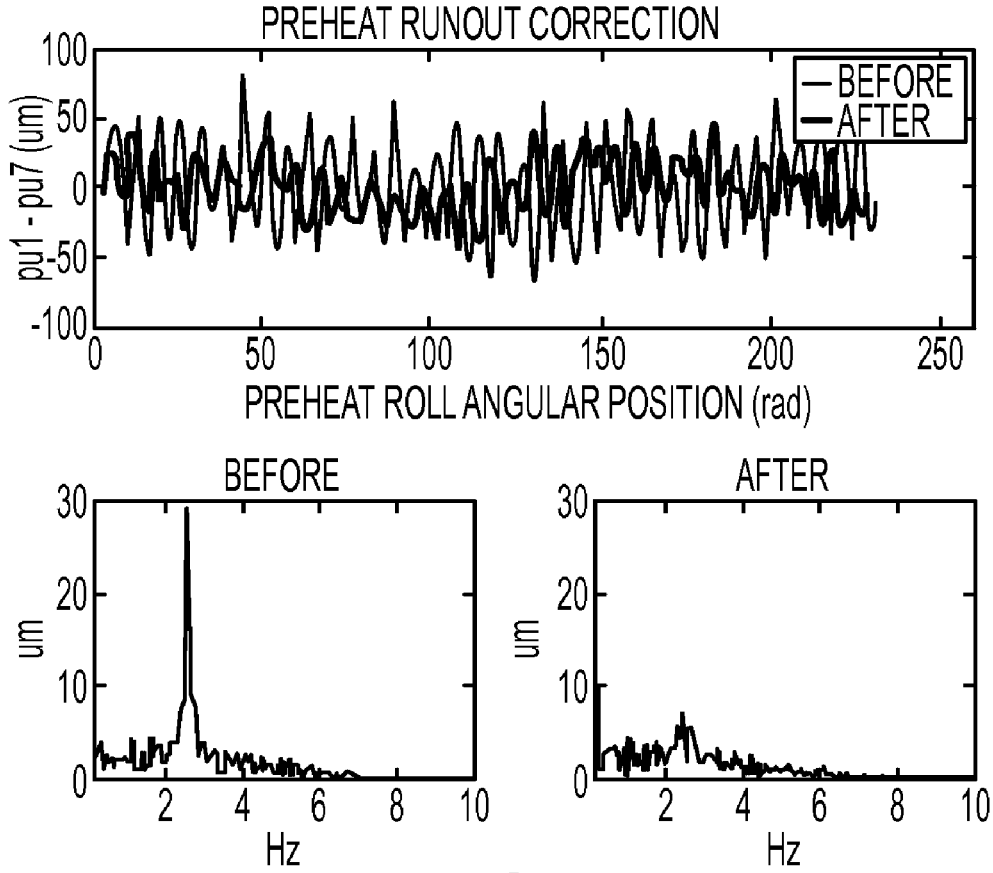
FIG. 3 is a plot of experimental results that demonstrate the effectiveness of using a varying roller radius in an image registration process.
Figure 4:
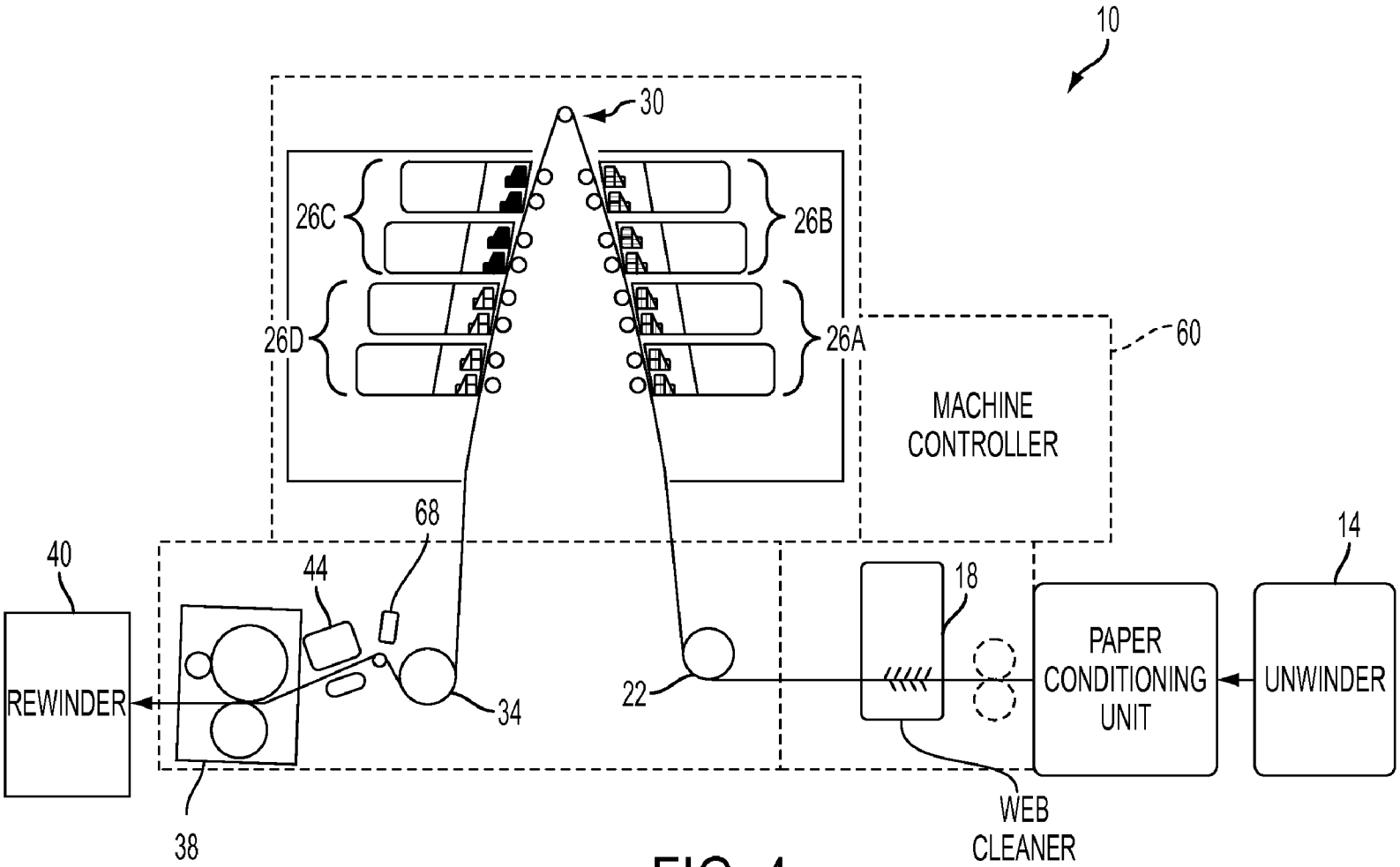
FIG. 4 is a block diagram of a web printing system.

The experimental results that demonstrate the effectiveness of using a varying roller radius in an image registration process is shown in FIG. 3. The top plot shows registration errors when a constant radius for the rollers are used and the registration errors occurring when a varying radius for the rollers are used. The bottom left plot shows the FFT of the registration errors before compensation. A high peak at 2.5 Hz corresponds to the preheat roller (one of the rollers used for reflex printing) once around frequency at a given web velocity. The bottom right plot shows again the FFT of errors after the compensation. The compensated registration errors exhibited a substantially reduced peak at the 2.5 Hz frequency.

In operation, a test registration image is generated, the registration errors identified and used to solve for the compensation values of the changing radius at particular roller sectors. These changing radius values are stored to enable a controller to modify the radius of a roller in computations that determine a web velocity with reference to the radii of the rollers in the print zone. A firing signal is generated with reference to the computed web velocity and the signal is delivered to a print head proximate the roller having a radius that was modified with the runout compensation values during the web velocity computations. The firing signal energizes the inkjet nozzles in the print head to eject ink onto the web at a position that corresponds to the computed web velocity. The resulting firing signals adjust the timing for the ejection of the ink to compensate for the effect of runout error in the web velocity computation and the registration of the images printed by the print heads remains stable longer than in previously known implementations of image registration systems.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for compensating for runout errors in a moving web printing system comprising:

identifying runout error at a first roller driving a web of printable media;

generating a runout compensation value corresponding to the identified runout error;

identifying a velocity of the moving web with reference to encoder output corresponding to an angular velocity of the first roller and the generated runout compensation value; and delivering a firing signal to a print head proximate the first roller to energize the inkjet nozzles in the print head and eject ink onto the web at a position corresponding to the computed web velocity.

2. The method of claim 1, the runout error identification further comprising:

mechanically measuring the runout error.

3. The method of claim 1, the runout error identification further comprising:

printing ink with multiple print heads in a predetermined pattern;

scanning the printed ink; and measuring a distance between corresponding lines printed by different print heads.

4. The method of claim 1 further comprising:

mapping the identified runout error to a changing radius for a roller in a print zone.

5. The method of claim 4 further comprising:

mapping a radius change to each sector in a plurality of sectors for a circumference of the first roller.

6. The method of claim 5 wherein the mapping is implemented in a look-up table stored in a memory coupled to a controller.

7. The method of claim 1 further comprising:

identifying runout error at a second roller driving a web of printable media;

generating a runout compensation value corresponding to the identified runout error for the second roller;

identifying a velocity of the moving web at a print head positioned between the first roller and the second roller, the moving web velocity being computed with reference to encoder output corresponding to an angular velocity of the first roller and the generated runout compensation value for the first roller, an encoder output corresponding to an angular velocity of the second roller and the generated runout compensation value for the second roller, a distance between the first roller and the printer and a distance between the first roller and the second roller; and delivering a firing signal to the print head between the first roller and the second roller to energize the inkjet nozzles in the print head and eject ink onto the web at a position corresponding to the computed web velocity.

8. The method of claim 7 wherein the first roller has a radius that is not an integral multiple of a radius of the second roller.

9. A system for operating print head firing in a web printing system comprising:

a first roller configured to rotate in response to a web moving through a print zone of a web printing system;

a first encoder mounted proximate the first roller to generate a signal corresponding to an angular velocity of the first roller;

a print head positioned in the print zone proximate the web; and a controller coupled to the first encoder and the print head, the controller being configured to compute a web velocity for the web moving through the print zone with reference to the signal received from the first encoder and runout compensation values stored in a memory coupled to the controller and the controller sending a firing signal to the print head to operate the print head and eject ink onto the web at a position corresponding to the computed web velocity.

10. The system of claim 9 wherein the runout compensation values stored in the memory correspond to runout errors associated with the first roller or the first encoder.

11. The system of claim 9 further comprising:

an optical sensor mounted proximate the web at a position outside of the print zone, the optical sensor being configured to generate image data of the web as it moves past the optical sensor; and the controller is coupled to the optical sensor and further configured to send firing signals to a plurality of print heads in the print zone to eject ink onto the web moving through the print zone to form a predetermined pattern and to identify registration errors in the image data of the web and the predetermined pattern generated by the optical sensor.

12. The system of claim 11, the controller being further configured to generate the runout error compensation values with reference to the identified registration errors.

13. The system of claim 12 wherein the runout compensation values are radius changes to the first roller stored in the memory coupled to the controller and the controller is configured to vary a radius of the first roller with the radius changes during computation of the web velocity.

14. The system of claim 13 wherein the runout compensation values are stored in a look-up table indexed by sectors for a circumference of the first roller.

15. The system of claim 9 further comprising:

a second roller configured to rotate in response to the web moving through the print zone of the web printing system;

a second encoder mounted proximate the second roller to generate a signal corresponding to an angular velocity of the second roller; and the controller is coupled to the second encoder, the controller being configured to compute a web velocity for the web moving through the print zone with reference to the signal received from the first encoder, the second encoder and runout compensation values stored in a memory coupled to the controller and the controller sending a firing signal to the print head to operate the print head and eject ink onto the web at a position corresponding to the computed web velocity.

16. The system of claim 15 wherein the first roller has a radius that is not an integral multiple of the second roller.

17. The system of claim 16 wherein runout compensation values for the first roller correspond to radius changes for the first roller and runout compensation values for the second roller correspond to radius changes for the second roller.

18. The system of claim 17 wherein the radius changes for the first roller are stored in a first look-up table indexed by sectors for a circumference of the first roller and the radius changes for the second roller are stored in a second look-up table indexed by sectors for a circumference of the second roller.

19. The system of claim 15 wherein the controller is configured to compute web velocity with a double reflex process.

* * * * *